United States Patent [19]

Walsh

[11] 4,428,826

[45] Jan. 31, 1984

[54] DEWAXING AND UPGRADING OF RAW SHALE OILS

[75] Inventor: Dennis E. Walsh, Richboro, Pa.

[73] Assignee: Mobil Oil Corporation, New York, N.Y.

[21] Appl. No.: 409,395

[22] Filed: Aug. 19, 1982

[51] Int. Cl.[3] ..... C10G 11/05; C10G 47/16

[52] U.S. Cl. ..... 208/120

[58] Field of Search ..... 208/120, 111

[56] References Cited

U.S. PATENT DOCUMENTS 3,968,024 7/1976 Gorring et al. ..... 208/111
4,263,129 4/1981 Chen et al. ..... 208/120 X
4,284,529 8/1981 Shihabi ..... 208/111
4,315,814 2/1982 Shihabi ..... 208/111
4,360,419 11/1982 Miller ..... 208/120 X

*Primary Examiner*—Delbert E. Gantz
*Assistant Examiner*—George Schmitkons
*Attorney, Agent, or Firm*—Alexander J. McKillop; Michael G. Gilman; Charles J. Speciale

[57] ABSTRACT

Raw shale oil is selectively dewaxed to lower the pour point by contacting a shale oil charge with a low acid crystalline zeolite. The low acid catalysts can be formed by extensive ion exchange of ZSM-5 type catalysts. The shale oil is dewaxed in the absence of hydrogen at high temperature and low pressure.

11 Claims, 5 Drawing Figures

SHALE OIL

75F

NaZSM-5

γ-Alumina

DEWAXING AND UPGRADING OF RAW SHALE OILS

BACKGROUND OF THE INVENTION

1. Field of the Invention

This invention relates to a process for dewaxing raw shale oil to lower the pour point and produce lower molecular weight materials from a portion or all of the charge. In particular, the invention relates to a process of shape selectively dewaxing and improving the boiling range of raw shale oil at fluid catalytic cracking conditions over low acidity, medium pore size catalysts.

The cracking and/or hydrocracking of petroleum stocks is in general well known and widely practiced. It is known to use various zeolites to catalyze cracking and/or hydrocracking processes. The cracking may have the intent to convert a certain class of compounds in order to modify a characteristic of the whole petroleum stock. Exemplary of this type of conversion is shape selective conversion of straight and slightly branched aliphatic compounds of 12 or more carbon atoms to reduce pour point, pumpability, and/or viscosity of heavy fractions which contain these waxy constituents. The long carbon chain compounds tend to crystallize on cooling of the oil to an extent such that the oil will not flow, hence may not be able to be pumped or transported by pipelines. The temperature at which such mixture will not flow is designated the "pour point", as determined by standardized test procedures.

The pour point problem can be overcome by techniques known in the art for removal of waxes or conversion of those compounds to other hydrocarbons which do not crystallize at ambient temperatures. An important method for so converting waxy hydrocarbons is shape selective cracking or hydrocracking utilizing principals described in U.S. Pat. No. 3,140,322 dated July 7, 1964. Zeolitic catalysts for selective conversions of wax described in the literature include such species as mordenite, with or without added metal to function as a hydrogenation catalyst.

Particularly effective catalysts for catalytic dewaxing include zeolite ZSM-5 and related porous crystalline aluminosilicates as described in U.S. Pat. No. Re. 28,398 (Chen et al) dated Apr. 22, 1975. As described in that patent, drastic reductions in pour point are achieved by catalytic shape selective conversion of the wax content of heavy stocks with hydrogen in the presence of a dual-functional catalyst of a metal plus the hydrogen form of ZSM-5. The conversion of waxes is by scission of carbon to carbon bonds (cracking) and production of products of lower boiling point than the wax. However, only minor conversion occurs in dewaxing. For example, Chen et al describe hydrodewaxing of a full range shale oil having a pour point of +80° F. to yield a pumpable product of pour point at −15° F. The shift of materials from the fraction heavier than light fuel oil to lighter components was in the neighborhood of 9% conversion.

Among the less specialized techniques for producing products of lower molecular weight than the hydrocarbon charge stock are catalytic cracking and catalytic hydrocracking. Catalytic cracking involves contacting the heavy hydrocarbon charge with a porous acidic solid catalyst at elevated temperatures in the range of 850° to 1000° F. to yield the desired lower boiling liquid product of greater value than the liquid charge (e.g., motor gasoline) together with normally gaseous hydrocarbons and coke as by-products Hydrocracking employs a porous acidic catalyst similar to that used in the catalytic cracking associated with the hydrogenation component such as metals of Groups VI and VIII of the Periodic Table. An excess of hydrogen is supplied to the hydrocracking reactor under superatmospheric pressure at lower temperature than those characteristic of catalytic cracking, (about 650° F.).

Since the introduction of zeolite catalysts as exemplified by U.S. Pat. No. 3,140,249, a large proportion of the capacity for catalytic cracking and hydrocracking has been converted to use such highly active catalysts. The high activity zeolite catalysts are characterized by a very low content of alkali metal. Sodium, for example, is present as a cation in synthetic faujasites by reason of their manufacture. Expensive ion exchange operations are carried out in the preparation of cracking and hydrocracking catalysts from synthetic faujasite to replace the sodium or other alkali metal by protons or polyvalent metal cations.

It has been recognized that such zeolites can function as catalysts when containing a moderate percentage of sodium. Thus Kimberlin and Gladrow U.S. Pat. No. Re. 26,188 exhibits data showing cracking activity of a faujasite from which only one-third of the sodium has been removed by ion exchange. The extremely high activity of such catalysts as zeolite ZSM-5 has been moderated for specialized purposes by using the zeolite in the partially sodium form. See, for example, U.S. Pat. No. 3,899,544.

Zeolite ZSM-5 preparation is described in U.S. Pat. No. 3,702,886 which also describes several processes in which the zeolite is an effective catalyst, including cracking and hydrocracking. That zeolite is shown to be prepared from a forming solution which contains organic cations, namely alkyl substituted ammonium cations. Those large organic cations then occupy cationic sites of the zeolite and block pores at least partially. The conventional method for removing the organic cations is to burn them out with air at elevated temperature, leaving a proton at the site previously occupied by the organic cation. Sodium, or other alkali metal, at other cationic sites may then be ion exchanged to provide protons or multivalent metals as desired to prepare catalysts for cracking, hydrocracking and other purposes.

At present, there is increased involvement in locating as well as refining alternative petroleum stocks so as to obtain premium hydrocarbon fractions therefrom. Shale oil is an important alternative petroleum resource which is being recovered and refined. However, shale oil is a waxy crude petroleum which is also high in basic nitrogen content. For the most part, the components of shale oil have boiling points in the upper levels of boiling ranges of natural petroleum, upwards of 50% of the total boiling being above 750° F. Such high boiling fractions and high nitrogen content present obstacles to deriving premium products from shale oil. Crudes of high pour point are not suited to pipeline transportation because they cannot be pumped and will not flow in pipes at temperatures below the pour point, which may be 50° F. or higher. Additionally, highly acidic catalysts such as for cracking and hydrocracking petroleum feedstocks as described previously, are quite vulnerable to poisoning by the basic nitrogen containing compounds in the shale oil.

2. Brief Description of the Prior Art

Among the U.S. Patents which relate to the cracking and/or hydrocracking of petroleum stocks over ZSM-5 type zeolites include U.S. Pat. No. Re. 28,398, discussed previously, which patent discloses a specific example for reducing the pour point of shale oil by hydroprocessing techniques. The shale oil was contacted with a ZSM-5 type catalyst at 500 psig, 800° F., and 2000 s.c.f.s./bbl. hydrogen circulation. The feedstock had a pour point of +80° F. while the liquid product was reduced to a pour point of −15° F.

U.S. Pat. No. 3,968,024, issued July 6, 1976, discloses catalytic hydrodewaxing of gas oils and to the treatment of syn crudes from shale among others. The process is operated at conditions which include low pressures of about 100 to 3000 psig, temperatures of about 500°0 F.–1100° F. and a hydrogen to hydrocarbon mole ratio of about 0 to 20 and using a catalyst comprising microcrystalline ZSM-5 zeolite. However, no specific example is given of dewaxing a shale oil having a pour point of +80° F. Additionally, the patent cautions that the content of Group 1A metal cations should in no case be so large as to effectively inactivate the catalyst.

U.S. Pat. No. 4,263,129 is concerned with the conversion of relatively heavy hydrocarbon streams including shale oil to produce lower molecular weight materials from a portion or all of the charge. Conversion takes place in the presence of hydrogen, at a minimum pressure of 200 psig over a low acidity zeolite such as NaZSM-5.

SUMMARY OF THE INVENTION

In accordance with the present invention, raw shale oil is shaped selectively dewaxed and undergoes an improvement in boiling range by processing the shale oil at fluid catalytic cracking conditions, i.e., low pressures of about 0 to 100 psig and high temperatures of about 450° to 540° C. over a low acidity, medium pore size zeolite having a silica/alumina ratio above 12 and preferably also having a constraint index between about 1 and 12. In the preferred embodiments, the low acidity is achieved by using the sodium form of a zeolite typified by zeolite ZSM-5. Hydrogen is not employed in the process.

DESCRIPTION OF THE PREFERRED EMBODIMENTS

Figure 1:
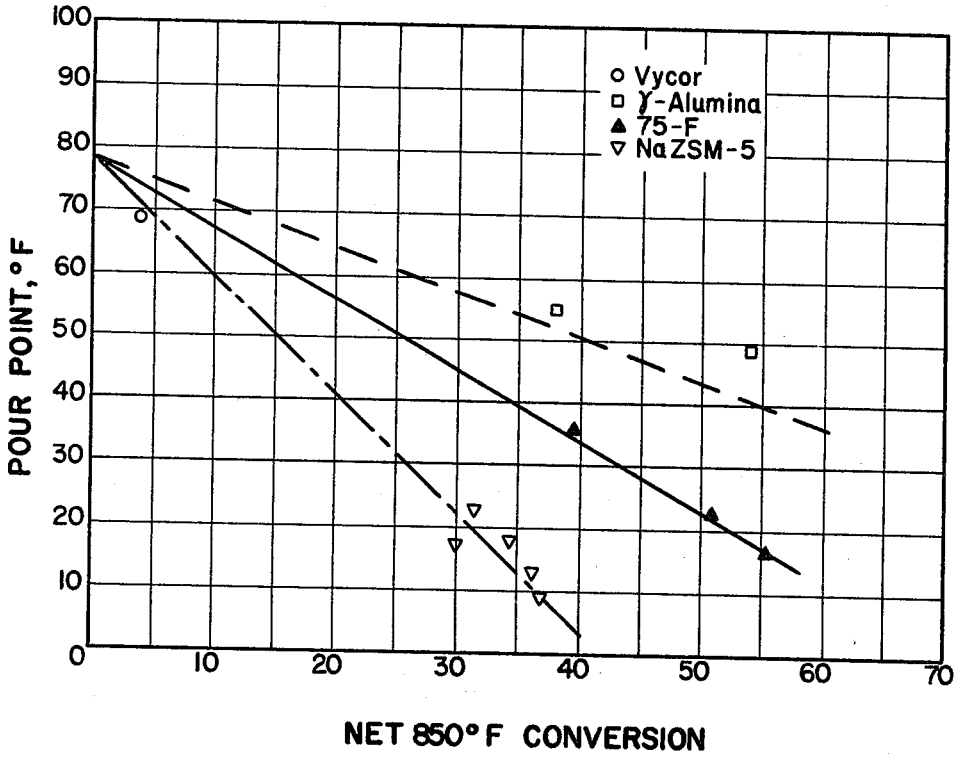
FIG. 1 is a graph illustrating the pour point (°F.) vs. the net conversion to 850° F.− products, by the dewaxing of shale oil by four different catalysts.
Figure 2:
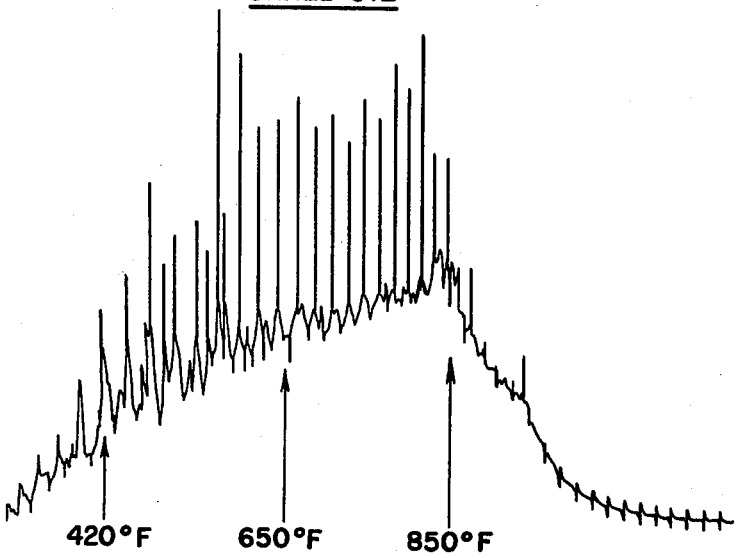
FIG. 2 is a gas chromatograph trace of a raw shale oil charge stock.
Figure 3:
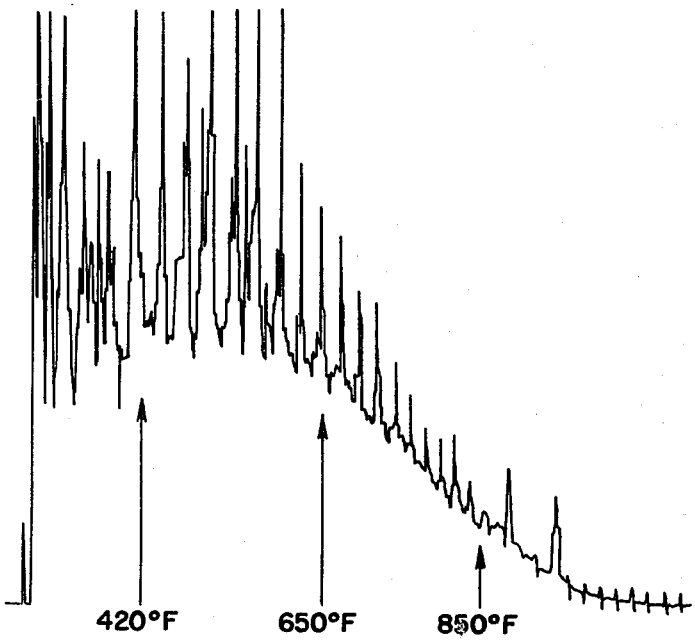
FIG. 3 is a gas chromatograph trace of the shale oil product after conversion of the shale oil in the presence of a REY zeolite.
Figure 4:
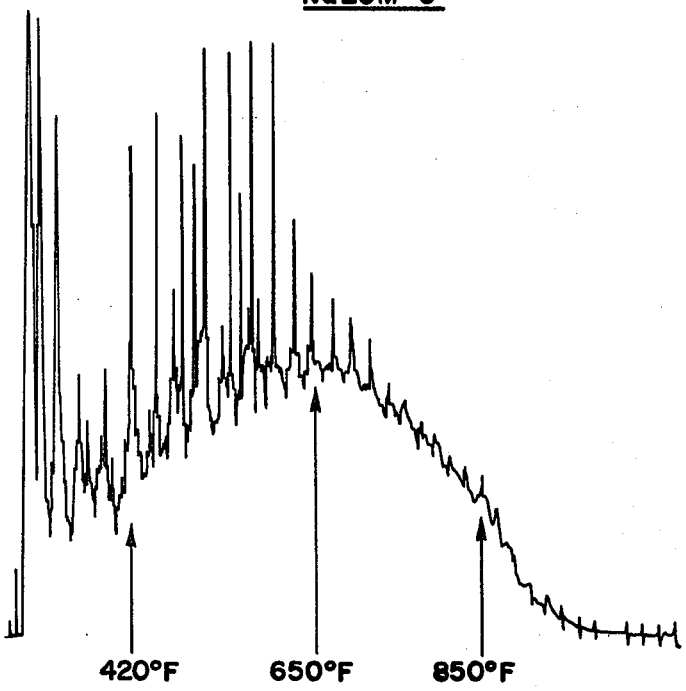
FIG. 4 is a gas chromatograph trace of a shale oil product converted in the presence of the low acidity, medium pore size zeolite of the present invention.
Figure 5:
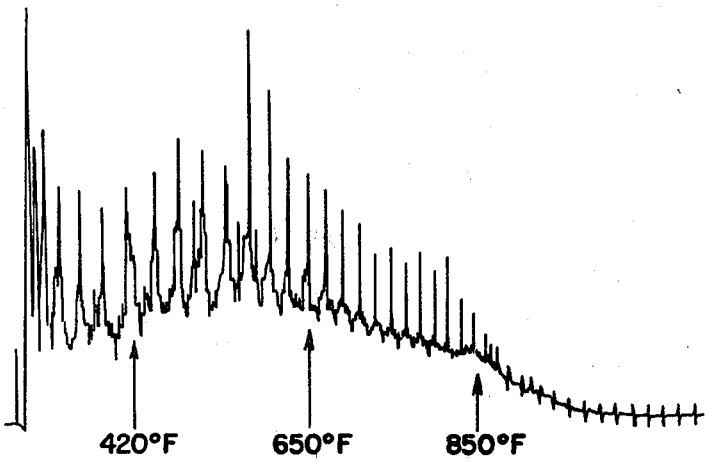
FIG. 5 is a gas chromatograph trace of a shale oil product converted in the presence of gamma-alumina.

A preferred use of the present invention is for the conversion of shale oil in the field to provide a product suitable for transmission by pipeline. Shale oil is a waxy crude of high pour point which is not readily suitable to pipeline transportation because the shale oil cannot be pumped and will not flow in pipes at temperatures below the pour point, which may be 50° F. and most often higher.

Although the concept of reducing pour point of waxy crude oil is not new, the utilization of the newly discovered characteristics of alkali metal exchanged ZSM-5 allows the dewaxing of shale oil at typical fluid catalytic cracking conditions and thus provides advantages not previously available in the processing of raw shale oil.

The low acidity zeolite useful in the present invention is unique in its resistance to metals, nitrogen, and sulfur, and can be used in the absence of hydrogen without experiencing rapid deactivation problems. Unlike H-ZSM-5 with or without hydrogenation metal function, alkali metal exchanged ZSM-5 type zeolites reduce pour point and viscosity of the waxy raw shale oil without forming large amounts of lower hydrocarbon gaseous products or coke, so that liquid recovery of the shale oil processed is 80% or better. In accordance with the present invention, the shale oil is shape selectively dewaxed and the boiling range upgraded by carrying out the process in the gas phase at a low pressure, preferably below 100 psig, and most preferably below 75 psig and at high temperatures between about 450° to 540° C. in the absence of hydrogen. The low acidity zeolite catalyst shows no deleterious effects from the high basic nitrogen content of the shale oil and is low aging over extended cracking intervals. Although the nitrogen concentration of the shale oil is not significantly reduced by the catalytic cracking process of the present invention, the product oils are easier to denitrogenate that the raw shale oil by virtue of boiling range upgrading of basic nitrogen containing compounds contained within the raw shale oil.

The Catalyst

The catalyst used in the present invention is a low acidity form of a class of zeolites which have been found to be extremely active in the acid form. In that form the cationic sites are occupied by protons introduced by ion exchange with an acid or an ammonium (including substituted ammonium) cation which is then decomposed by heat to a proton. Alternatively, at least a portion of the cationic sites may be occupied by polyvalent metals. For use in the present invention, these very high acidities inherent in zeolites such as zeolite ZSM-5 are drastically reduced. Preferably, the acidity is reduced by extensive ion exchange with sodium or other alkali metal. The invention may also be practiced with such zeolites of very high silica/alumina ratio or by steaming of the active form of the zeolite. It will be recognized by those skilled in the art of zeolite catalysis that substitution of sodium or like cations and steaming are generally recognized as means to "poison" a zeolite catalyst by severely impairing its activity. These agencies are generally avoided in preparation and use of zeolite catalysts in cracking or hydrocracking.

The acid activity of zeolite catalysts is conveniently defined by the alpha scale described in an article published in Journal of Catalysis, Vol. VI, pp. 278–287 (1966). The alpha scale so described will be used herein to define activity levels.

In general, the catalysts used in accordance with this invention are crystalline zeolites having a silica/alumina ratio greater than 12. Preferably the zeolite catalyst has a Constraint Index (C.I.) between about 1 and about 12.

Zeolites characterized by such constraint indices induce profound transformations of aliphatic hydrocarbons to aromatic hydrocarbons in commercially desirable yields and are generally highly effective in conversion reactions involving aromatic hydrocarbons. These zeolites retain a degree of crystallinity for long periods in spite of the presence of steam at high temperature which induces irreversible collapse of the framework of other zeolites, e.g. of the X and A type. Furthermore, carbonaceous deposits when formed, may be removed by burning at higher than usual temperatures to restore activity. In many environments the zeolites of this class exhibit very low coke forming capability, conducive to very long times on stream between burning regenerations.

An important characteristic of the crystal structure of this class of zeolites is that it provides constrained access to, and egress from the intracrystalline free space by virtue of having a pore dimension greater than about 5 Angstroms and pore windows of about a size such as would be provided by 10-membered rings of oxygen atoms. It is to be understood, of course, that these rings are those formed by the regular disposition of the tetrahedra making up the anionic framework of the crystalline aluminosilicate, the oxygen atoms themselves being bonded to the silicon or aluminum atoms at the centers of the tetrahedra. Briefly, the preferred type zeolites useful in this invention possess a silica to alumina mole ratio of at least about 12 preferably in combination with a structure providing constrained access to the crystalline free space.

The zeolite will have a silica/alumina ratio greater than 12. In one embodiment, the desired low acid activity of the catalyst is achieved by unusually high silica/alumina ratio, greater than 1000, preferably upwards of about 1500.

The silica to alumina ratio referred to may be determined by conventional analysis. This ratio is meant to represent, as closely as possible, the ratio in the rigid anionic framework of the zeolite crystal and to exclude aluminum in the binder or in cationic or other forms within the channels. Such zeolites, after activation, acquire an intracrystalline sorption capacity for normal hexane which is greater than that for water, i.e. they exhibit "hydrophobic" properties. It is believed that this hydrophobic character is advantageous in the present invention.

The type zeolites described freely sorb normal hexane and have a pore dimension greater than about 5 Angstroms. In addition, the structure will preferably provide constrained access to larger molecules. It is sometimes possible to judge from a known crystal structure whether such constrained access exists. For example, if the only pore windows in a crystal are formed by 8-membered rings of oxygen atoms, then access by molecules of larger cross-section than normal hexane is excluded and the zeolite is not of the constrained type. Windows of 10-membered rings are preferred, although, in some instances, excessive puckering or pore blockage may render these zeolites ineffective. Twelve-membered rings do not generally appear to offer sufficient constraint to produce the advantageous conversions, although puckered structures exist such as TMA offretite which is a known effective zeolite. Also, structures can be conceived, due to pore blockage or other cause, that may be operative.

Rather than attempt to judge from crystal structure whether or not a zeolite possesses the necessary constrained access, a simple determination of the "constraint index" may be made by passing continuously a mixture of an equal weight of normal hexane and 3-methylpentane over a sample of zeolite at atmospheric pressure according to the following procedure. A sample of the zeolite, in the form of pellets or extrudate, is crushed to a particle size about that of coarse sand and mounted in a glass tube. Prior to testing, the zeolite is treated with a stream of air at 1000° F. for at least 15 minutes. The zeolite is then flushed with helium and the temperature adjusted between 550° F. and 950° F. to give an overall conversion between 10% and 60%. The mixture of hydrocarbons is passed at 1 liquid hourly space velocity (i.e., 1 volume of liquid hydrocarbon per volume of zeolite per hour) over the zeolite with a helium dilution to give a helium to total hydrocarbon mole ratio of 4:1. After 20 minutes on stream a sample of the effluent is taken and analyzed, most conveniently by gas chromatography, to determine the fraction remaining unchanged for each of the two hydrocarbons.

The "constraint index" is calculated as follows:

$$\text{Constraint Index} = \frac{\log_{10}(\text{fraction of n-hexane remaining})}{\log_{10}(\text{fraction of 3-methylpentane remaining})}$$

The constraint index approximates the ratio of the cracking rate constants for the two hydrocarbons. Preferred zeolites for the present invention are those having a constraint index in the approximate range of 1 to 12. Constraint Index (C.I.) values for some typical zeolites are:

| ZEOLITE | C.I. |
|---|---|
| ZSM-5 | 8.3 |
| ZSM-11 | 8.7 |
| ZSM-12 | 2 |
| ZSM-38 | 2 |
| ZSM-35 | 4.5 |
| TMA Offretite | 3.7 |
| Beta | 0.6 |
| ZSM-4 | 0.5 |
| H-Zeolon | 0.4 |
| REY | 0.4 |
| Amorphous Silica-Alumina | 0.6 |
| Erionite | 38 |

It is to be realized that the above constraint index values typically characterize the specified zeolites but that such are the cumulative results of several variables used in determination and calculation thereof. Thus, for a given zeolite depending on the temperatures employed within the aforenoted range of 550° F. to 950° F., with accompanying conversion between 10% and 60%, the constraint index may vary within the indicated approximate range of 1 to 12. Likewise, other variables such as the crystal size of the zeolite, the presence of possible occluded contaminants and binders intimately combined with the zeolite may affect the constraint index. It will accordingly be understood by those skilled in the art that the constraint index, as utilized herein, while affording a highly useful means for characterizing the zeolites of interest is approximate, taking into consideration the manner of its determination, with probability, in some instances, of compounding variable extremes.

While the above experimental procedure will enable one to achieve the desired overall conversion of 10% to 60% for most catalyst samples and represents preferred conditions, it may occasionally be necessary to use somewhat more severe conditions for samples of very low acid activity, such as those having a very high silica to alumina ratio. In those instances, a temperature of up to about 1000° F. and a liquid hourly space velocity of less than one, such as 0.1 or less, can be employed in order to achieve a minimum total conversion of about 10%.

The preferred class of zeolites defined herein is exemplified by ZSM-5, ZSM-11, ZSM-12, ZSM-35, ZSM-38 and other similar materials. U.S. Pat. No. 3,702,886 describing and claiming ZSM-5 is incorporated herein by reference.

ZSM-11 is more particularly described in U.S. Pat. No. 3,709,979, the entire contents of which are incorporated herein by reference.

ZSM-12 is more particularly described in U.S. Pat. No. 3,832,449, the entire contents of which are incorporated herein by reference.

ZSM-35 is more particularly described in U.S. Pat. No. 4,016,245, the entire contents of which are incorporated herein by reference.

ZSM-38 is more particularly described in U.S. Pat. No. 4,046,859, the entire contents of which are incorporated herein by reference.

In addition to those zeolites, the invention in its broader aspects of zeolites having a silica/alumina ratio above 12 also contemplates such zeolites as Beta, described in U.S. Pat. No. Re. 28,341.

The specific zeolites described, when prepared in the presence of organic cations, are catalytically inactive possibly because the intracrystalline free space is occupied by organic cations from the forming solution. They may be activated by heating in an inert atmosphere at 1000° F. for one hour, for example followed by base exchange with ammonium salts followed by calcination at 1000° F. in air. The presence of organic cations in the forming solution may not be absolutely essential to the formation of this type zeolite; however, the presence of these cations does appear to favor the formation of this special type of zeolite. More generally in most applications it is desirable to activate this type catalyst by base exchange with ammonium salts followed by calcination in air at about 1000° F. for from about 15 minutes to about 24 hours.

Natural zeolites may sometimes be converted to this type zeolite catalyst by various activation procedures and other treatments such as base exchange, alumina extraction and calcination, in combinations. Natural minerals which may be so treated include ferrierite, brewsterite, stilbite, dachiardite, epistilbite, heulandite, and clinoptilolite. The preferred crystalline aluminosilicates are ZSM-5, ZSM-11, ZSM-12, ZSM-35, and ZSM-38, with ZSM-5 particularly preferred.

In a preferred aspect of this invention, the zeolites hereof are selected as those having a crystal framework density, in the dry hydrogen form, of not substantially below about 1.6 grams per cubic centimeter. It has been found that zeolites which satisfy all three of these criteria are most desired. Therefore, the preferred zeolites of this invention are those having a constraint index as defined above of about 1 to about 12, a silica to alumina ratio of at least about 12 and a dried crystal density of not less than about 1.6 grams per cubic centimeter. The dry density for known structures may be calculated from the number of silicon plus aluminum atoms per 1000 cubic Angstroms, as given, e.g., on page 19 of the article on Zeolite Structure by W. M. Meier. This paper, the entire contents of which are incorporated herein by reference, is included in "Proceedings of the Conference on Molecular Sieves, London, April 1967", published by the Society of Chemical Industry, London, 1968. When the crystal structure is unknown, the crystal framework density may be determined by classical pyknometer techniques. For example, it may be determined by immersing the dry hydrogen form of the zeolite in an organic solvent which is not sorbed by the crystal. It is possible that the unusual sustained activity and stability of this class of zeolites is associated with its high crystal anionic framework density of not less than about 1.6 grams per cubic centimeter. This high density, of course, must be associated with a relatively small amount of free space within the crystal, which might be expected to result in more stable structures. This free space, however, is important as the locus of catalytic activity.

Crystal framework densities of some typical zeolites are:

| ZEOLITE | VOID VOLUME | FRAMEWORK DENSITY |
|---|---|---|
| Ferrierite | 0.28 cc/cc | 1.76 g/cc |
| Mordenite | .28 | 1.7 |
| ZSM-5, -11 | .29 | 1.79 |
| Dachiardite | .32 | 1.72 |
| L | .32 | 1.61 |
| Clinoptilolite | .34 | 1.71 |
| Laumontite | .34 | 1.77 |
| ZSM-4 (Omega) | .38 | 1.65 |
| Heulandite | .39 | 1.69 |
| P | .41 | 1.57 |
| Offretite | .40 | 1.55 |
| Levynite | .40 | 1.54 |
| Erionite | .35 | 1.51 |
| Gmelinite | .44 | 1.46 |
| Chabazite | .47 | 1.45 |
| A | .5 | 1.3 |
| Y | .48 | 1.27 |

When synthesized in the alkali metal form, the zeolite of low acid activity by reason of very high silica/alumina ratio or steaming is conveniently converted to the hydrogen form, generally by intermediate formation of the ammonium form as a result of ammonium ion exchange and calcination of the ammonium form to yield the hydrogen form. In addition to the hydrogen form, other forms of the zeolite wherein the original alkali metal has been reduced to less than about 1.5 percent by weight may be used. Thus, the original alkali metal of the zeolite may be replaced by ion exchange with other suitable ions of Groups IB to VIII of the Periodic Table, including, by way of example, calcium or rare earth metals.

The zeolites used according to the invention have low alpha values, less than about 10. Preferably, the alpha value is substantially lower than unity. As noted, the low acid activity may be achieved by using zeolites of very high silica/alumina ratio or by severe high temperature steaming of zeolites having lower silica/alumina ratio, for example zeolite ZSM-5 of ratio 40 may be treated with 100% steam at 1200° F. for a period of time (several hours) adequate to reduce the acid activity to the necessary level.

Preferably, the low acidity is achieved by extensive ion exchange of the zeolite with sodium or other alkali metal cations. Silica/alumina ratios in the range of 12 to aluminum free will generally characterize the zeolites preferred in this form of the invention. Particularly preferred zeolites may be in the range of 20–2000. Though low acidity cation exchanged forms of the zeolite are less active for dewaxing than their high acidity counterparts, they exhibit superior overall performance from the combined viewpoints of activity, product selectivity and stability.

Sodium content of the zeolites will vary inversely with the silica/alumina ratio since it is the aluminum atoms which provide cationic sites suitable for acceptance of the alkali metal ion. Depending on that ratio, sodium content may vary between 0.4 and 5.2 weight percent of the metal, with preferred sodium contents ranging between 0.75 and 3.4 weight percent sodium as metal. Content of the other alkali metals will vary from those numbers on a weight basis in proportion to atomic weights. The alkali metal content generally can be expressed as 0.17 to 2.26, preferably 0.33 to 1.50 milliequivalents per gram. Sodium content in excess of satisfying cationic sites is considered desirable. The reason is not clearly understood. For example, ZSM-5 containing about 40 ppm of Al and 1% Na is a very good catalyst.

The low acidity alkali metal zeolites are prepared by ion exchange of the zeolite with an aqueous solution of an alkali metal salt of hydroxide at high pH values. In the following examples, care was taken to assure complete ion exchange.

Example 1

Sodium ZSM-5 was prepared by the addition of 3.0 gms of 14–30 mesh $NH_4$ZSM-5 at room temperature to 150 ml of 0.2N NaCl solution having a pH of 10.0 (pH adjusted with 0.1N NaOH). The mixture was maintained at room temperature for 48 hours with occasional agitation by swirling. The pH of the solution was monitored frequently and adjusted to 10.0 with 0.1N NaOH as required. Before overnight contact, the pH was adjusted to 11.0. After 48 hours, the liquid was decanted and replaced with 150 ml of fresh NaCl/NaOH solution. The exchange was completed by 53 hours as judged by the constancy of the pH. The catalyst was washed with 150 ml of dilute NaOH (pH=10) solution and dried at 130° C.

Example 2

A further batch of NaZSM-5 was prepared in the same manner as in Example 1, except that 30 gms of powdered sample of a large crystal ZSM-5 was used. The sample was added to 1500 ml of 0.3N alkaline NaCl solution and a magnetic stirrer was used to assure good mixing. As in the previous example the pH was used to monitor the exchange and adjustment was necessary every few hours with sodium hydroxide to maintain an alkaline pH in the range of 10–11. The constancy of pH over a 24–48 hours period was used as the criterion to terminate the exchange. Using this approach, large crystal ZSM-5 was prepared with total exchange time of one week. The finished sample was fully exchanged as indicated by the atomic ratio of Na/Al shown in Table 1.

Example 3

Cesium ZSM-5 was prepared by ion exchanging 15 gms of 14/30 mesh $NH_4$ZSM-5 with 430 ml 1M CsCl at room temperature. Two exchanges were made with pH in the range 10–11 adjusted with a dilute solution of CsOH. As in the case of Example 1, the finished catalyst was washed only once after the second exchange with aqueous CsOH solution of pH=10–11 and dried at 130° C. The finished sample was fully exchanged as indicated by the elemental analysis shown in Table 1.

TABLE 1

Compositional Analysis of Alkali Metal Exchanged

| Composition, Wt % | ZSM-5 NaZSM-5 (Example 2) | CsZSM-5 (Example 3) |
|---|---|---|
| M(Na or Cs) | 1.02 | 12.0 |
| $SiO_2$ | 87.75 | 74.85 |
| $Al_2O_3$ | 2.05 | 3.58 |
| Ash | 96.36 | 94.15 |
| $SiO_2/Al_2O_3$ | 73 | 36 |
| $M^+/Al$ | 1.1 | 1.3 |

The residual acid activity of the alkali metal zeolite was measured in two ways: (1) the standard alpha test and (2) hexene-1 isomerization test. The latter test is particularly useful for rating low acid activity catalysts with alpha values below 1. The test was carried out at 800° F. using a 5.3 mole ratio of He and Hexene-1, flowing at 20–300 cc/min over 2 to 100 mg of catalysts mixed with 1 cc 30/60 mesh Vycor (HF treated and air calcined) depending on activity. For a catalyst of 1 alpha, the corresponding rating based on the hexene-1 test would be 1800.

TABLE 2

Residual Acid Activity of Alkali Metal Exchanged

| Catalyst | ZSM-5 Alpha | Hexene-1 |
|---|---|---|
| Ex. 1 NaZSM-5 | 0.05 | — |
| Ex. 2 NaZSM-5 | 0.06 | |
| Ex. 2 NaZSM-5 | $9 \times 10^{-3}$* | 16 |
| Ex. 3 CsZSM-5 | 0.05 | — |
| Ex. 3 CsZSM-5 | $4 \times 10^{-3}$* | 8 |
| Vycor | $3 \times 10^{-5}$* | 0.05 |

*Calculated value 1 = 1800 $k_{hexene\text{-}1}$

Various other alkali metal salts can be used to provide cations in the ion exchange of the zeolite, including but not limited to $NaNO_3$, $NaHCO_3$, etc. The number of exchanges necessary to provide the proper acidity can be simply determined by measuring the acid activity by either of the above tests after ion exchange and adjusting the numbers of exchanges for the particular alkali metal salt depending upon the acid activity measured.

It is shown below that low acidity ZSM-5 such as NaZSM-5 is an effective shale oil conversion catalyst which is non-aging, resistant to nitrogen and sulfur compounds in the feedstock. NaZSM-5 selectively reduces the 650° F.+ components of the shale oil, converting the wax to naphthas and light distillates, drastically reducing the pour point. Unsteamed and presteamed versions of NaZSM-5 behave similarly under the conditions tested.

The catalyst is effective at a lower pressure than that required by known shale oil treating catalysts or conventional resid hydrotreating catalysts which require the presence of hydrogen. Instead of operating at 500 psig and hydrogen circulation as in U.S. Pat. No. Re. 28,398, or operating at pressures above 200 psig in the presence of hydrogen as set forth in U.S. Pat. No. 4,263,129, the operating pressure can be reduced to below 100 psig in the absence of hydrogen with the catalyst.

The novel catalyst compositions can therefore reduce the cost of upgrading shale oils. Significant savings in capital investment and operating cost can be realized by virtue of the low pressure requirement, long operating cycles and the regenerability of the catalyst. Additional benefits in the uplift of product value are also contemplated.

Process Conditions

The alkali metal zeolites of this invention are utilized under conditions similar to those employed in conventional catalytic cracking. The zeolite catalyst does not contain a hydrogenation component. The conversion with the present catalyst is selective, that is at a given conversion level more paraffin wax removal is obtained than when other catalytic materials are used thereby greatly reducing the pour point of the liquid product. That advantage is enhanced by a characteristically long onstream life of the catalyst. Additionally, hydrogen circulation is not required as conventionally used in upgrading shale oil and the pressures and temperatures used are typical of FCC type conditions.

Temperature of the reaction is between 450° C. and 540° C., preferably between 480° C. and 520° C. Activity of the catalyst drops off below about 370° C., making it advisable to operate at a temperature above that level. At the temperatures of reaction used, most of the shale oil charge will be vapor, thus the conversion of the waxy components will occur in the gas phase.

Pressures employed will vary from about 0 to less than 100 psig, and preferably below 75 psig. Weight hourly space velocities can range from about 0.5 to 2.0.

Experimental

A full range shale oil, the properties of which are set forth in Table 3, was cracked in a fluidized bed reactor system employing separately a gamma-alumina, a rare earth exchanged Y zeolite commercial cracking catalyst, and a ZSM-5 as the fluidized medium. Operating conditions were 515±5° C., atmospheric pressure, and, in the cyclic runs, eight 20 minute oil cracking intervals each being followed by oxidative catalyst regeneration. Continuous runs processed the same total amount of oil as the cyclic runs with coke being removed only at run's end. Weight hourly space velocities were 1.0–1.4. Accumulated gas and liquid products were analyzed via gas chromatograph.

Three active catalysts were compared in cracking the shale oil charge set forth in Table 3. An unsteamed NaZSM-5 extrudate (65% ZSM-5 zeolite, 35% gamma-alumina) was prepared by exchanging the $NH_4+$ form of ZSM-5 with a $NaNO_3$ solution, the pH being adjusted to 8–9 using NaOH. Presteamed NaZSM-5 was prepared by sodium exchanging after first steaming the $NH_4+$ form of ZSM-5 at 850° F. for about 15 hours. A commercial equilibrium cracking catalyst (Filtrol 75-F) composed of rare earth exchanged zeolite Y in a silica-alumina matrix was compared with the NaZSM-5 catalyst as was gamma-alumina. The gamma-alumina was investigated "as is" and in a sodium treated (pH 8–9, sodium bicarbonate) version. An inert low surface area glass (vycor) was also compared.

Table 4 presents results obtained over vycor and the two versions of the gamma-alumina catalyst. Using a typical volume of bed solids and pumping rates, less than 5% conversion and little pour point reduction results utilizing the inert vycor (run 1). By contrast, (runs 2 and 3) using the different versions of gamma-alumina illustrate that over high surface area "inactive" solids, shale oil conversion proceeds readily providing 10–14 times the level realized over low surface area vycor. Sodium treatment apparently neutralizes the gamma-alumina surface as evidenced by the lower conversion obtained in (run 3) vs. (run 2). The higher conversion levels obtained over the gamma-aluminas, the incremental improvement in pour point over that derived from vycor must be considered modest and indicates the waxy character of the liquid products. The basic nitrogen levels in the total liquid product, when compared to the charge, show no substantial reductions.

Table 5 presents results obtained over the equilibrium commercial REY cracking catalyst. Conversions in excess of 50% are obtained in the cyclic runs (4 and 6) using this catalyst. Total liquid product pour points are about 30° F. lower than were obtained over gamma-alumina at a similar level of conversion indicating that the commercial catalyst is a better dewaxer than high surface area amorphous alumina. Substantial catalyst aging is evidenced by the results of (run 5) in which the same amount of oil is processed as in experiments 4 and 6 but with coke removal only at run's end. Lower conversion and higher pour point of the total liquid product result. Again, the total liquid product basic nitrogen levels indicate little or no reduction compared to the charge.

The results obtained over low acidity NaZSM-5 are shown in Table 6. Operating cyclically under conditions similar to the REY cracking catalyst, unsteamed NaZSM-5 (runs 7 and 9) attains about 20% lower conversion than REY. Pour points of the total liquid products, however, are as good as, or better than those obtained over the commercial catalyst at higher conversion indicating that NaZSM-5 is functioning as a shape selective dewaxing catalyst.

Indicative of low aging, continuous operation (run 8) shows behavior generally similar to that obtained cyclically (run 7) in contrast to the substantial aging which the commercial catalyst exhibited when not periodically regenerated.

Using a presteamed NaZSM-5 (run 10) provides results similar to those obtained with the unsteamed version. Also, like the unsteamed catalyst, the presteamed NaZSM-5 shows little sensitivity to lack of periodic generation (run 11). Furthermore, with increasing cracking time, not only are conversion and pour point maintained with both unsteamed and presteamed ZSM-5, but coke yields decline significantly.

Once more, basic nitrogen levels in the total liquid product do not indicate substantial reductions below that of the charge. However, while the levels are not significantly reduced, it is possible that much of the basic nitrogen in the product oils obtained from the various materials tested may be easier to denitrogenate, compared to the charge, having been upgraded to lighter ends.

The catalytic comparisons discussed above are illustrated in FIGS. 1–5. FIG. 1 shows that a given pour point can be obtained at a lower conversion level using NaZSM-5 than the commercial catalyst or the gamma-aluminas. Alternatively, at a given conversion level, NaZSM-5 provides a product having the lowest pour point of the materials tested.

FIGS. 2–5 present gas chromatographic traces of the raw shale oil charge and typical products obtained from processing over the various materials tested. While the commercial REY and gamma-alumina illustrate conversion of the back end of the shale oil, the presence of unconverted paraffin peaks in the 650° F.+ liquid is apparent. NaZSM-5, on the other hand, exhibits a marked reduction in the 650° F.+ paraffin peaks, converting these waxes to naphthas and low pour distillates without extensive conversion of other back end compounds, i.e. NaZSM-5 shape selectively dewaxes the shale oil.

TABLE 3

| PROPERTIES OF SHALE OIL CHARGE | |
|---|---|
| C (Wt. %) | 84.60 |
| H (Wt. %) | 11.42 |
| O (Wt. %) | 1.58 |
| N (Wt. %) (total) | 1.79 |
| N (Wt. %) (basic) | 1.30 |
| S (Wt. %) | 0.84 |
| Ash (Wt. %) | 0.02 |
| Ni (ppm) | 2.0 |
| V (ppm) | 1.5 |
| CCR (Wt. %) | 1.39 |
| IBP-420° F. (Wt. %) | 6.2 |
| 420-650° F. (Wt. %) | 33.4 |
| 650-850° F. (Wt. %) | 34.7 |
| 850° F.+ | 25.7 |
| Pour Point (°F.) | 79 |

TABLE 4

VYCOR AND GAMMA-ALUMINA RESULTS

Temperature (°C.): 515
Pressure (atm.): 1
Regeneration Interval: 20 min.
Acidity of Solids: $\alpha < .1$

| | Charge | Run No. 1 | 2 | 3 |
|---|---|---|---|---|
| Bed Material | | Vycor | Gamma-Alumina | Na Treated Gamma Alumina |
| WHSV | | 0.6 | 1.4 | 1.4 |
| Cat/Oil (wt/wt)[a] | | 5.2 | 2.2 | 2.2 |
| Products (wt. %) | | | | |
| $C_3^-$ | — | 0.6 | 6.5 | 1.8 |
| $C_4$'s | — | 0.1 | 1.1 | 0.2 |
| $C_5$ - 420° F. | 6.2 | 7.2 | 20.5 | 13.4 |
| 420-650° F. | 33.4 | 36.2 | 46.5 | 35.4 |
| 650-850° F. | 34.7 | 31.2 | 13.6 | 33.2 |
| 850° F.+ | 25.7 | 22.4 | 3.1 | 8.4 |
| Coke | — | 2.3 | 8.7 | 8.3 |
| Conversion[b] | — | 3.9 | 54.1 | 37.7 |
| Total Liquid Product Quality | | | | |
| N (total) | 1.79 | 2.2 | 1.69 | 1.69 |
| N (basic) | 1.30 | 1.30 | 1.20 | 1.20 |
| H/C (atomic) | 1.62 | 1.53 | 1.55 | 1.60 |
| CCR (wt. %) | 1.39 | 0.85 | 0.70 | 1.38 |
| Pour Point (°F.) | 79 | 68 | 49 | 55 |

[a]Weight of catalyst divided by weight of oil pumped prior to regeneration.
[b]Net 850° F.$^-$ conversion excluding coke.

$$\text{Net 850° F.}^- \text{ Conversion} = \frac{\text{Gas + 850° F.}^- \text{ Liquid Net}}{\text{850° F.}^+ \text{ Charge}}$$

TABLE 5

EQUILIBRIUM REY RESULTS

Temperature (°C.): 515
Pressure (atm.): 1
Regeneration Interval: 20 min. (except where noted)
Acidity of Catalyst: $\alpha = 0.4$

| | Charge | Run No. 4 | 5[c] | 6 |
|---|---|---|---|---|
| WHSV | | 1.0 | → | → |
| Cat/Oil (wt/wt)[a] | | 3.0 | 0.4 | 3.0 |
| Catalyst cumulative on stream time at run's end (min.) | | 153 | 305 | 459 |
| Products (wt. %) | | | | |
| $C_3^-$ | — | 4.0 | 1.6 | 4.2 |
| $C_4$'s | — | 0.4 | 0.1 | 1.1 |

TABLE 5-continued

EQUILIBRIUM REY RESULTS

Temperature (°C.): 515
Pressure (atm.): 1
Regeneration Interval: 20 min. (except where noted)
Acidity of Catalyst: $\alpha = 0.4$

| | Charge | Run No. 4 | 5[c] | 6 |
|---|---|---|---|---|
| $C_5$ - 420° F. | 6.2 | 23.0 | 16.1 | 17.7 |
| 420-650° F. | 33.4 | 42.7 | 40.0 | 47.6 |
| 650-850° F. | 34.7 | 18.4 | 26.7 | 16.8 |
| 850° F.+ | 25.7 | 7.3 | 12.6 | 5.2 |
| Coke | — | 4.2 | 2.8 | 7.4 |
| Conversion[b] | — | 55.6 | 39.7 | 51.0 |
| Total Liquid Product Quality | | | | |
| N (total) | 1.79 | 1.72 | 1.90 | 1.47 |
| N (basic) | 1.30 | 1.25 | 1.35 | 1.23 |
| H/C (atomic) | 1.62 | 1.54 | 1.62 | 1.51 |
| CCR (wt. %) | 1.39 | 0.37 | 0.71 | 0.35 |
| Pour Point (°F.) | 79 | 17 | 36 | 23 |

[a]Weight of catalyst divided by weight of oil pumped prior to regeneration.
[b]Net 850° F.$^-$ conversion excluding coke.
[c]Continuous Run - no periodic regeneration.

TABLE 6

NaZSM-5 RESULTS

Temperature (°C.): 515
Pressure (atm.): 1
Cracking Time: 20 min. (except where noted)
Acidity of Catalysts: $\alpha \leqq 1$

| | Charge | Run No. 7 | 8[c] | 9 | 10 | 11[c,d] |
|---|---|---|---|---|---|---|
| WHSV | | 1.1 | → | → | → | → |
| Cat/Oil (wt/wt)[a] | | 2.6 | 0.4 | 2.6 | 2.6 | 0.4 |
| Catalyst cumulative on stream time at run's end (min.) | | 153 | 308 | 461 | 153 | 308 |
| Products (wt. %) | | | | | | |
| $C_3^-$ | — | 6.5 | 3.3 | 5.0 | 6.5 | 5.6 |
| $C_4$'s | — | 2.3 | 0.9 | 1.2 | 2.9 | 2.1 |
| $C_5$ - 420° F. | 6.2 | 15.5 | 19.1 | 22.6 | 15.5 | 17.5 |
| 420-650° F. | 33.4 | 31.2 | 33.8 | 32.5 | 34.9 | 31.0 |
| 650-850° F. | 34.7 | 26.6 | 25.4 | 22.6 | 23.9 | 27.0 |
| 850° F.+ | 25.7 | 10.0 | 13.4 | 7.6 | 9.0 | 14.0 |
| Coke | — | 7.9 | 4.1 | 8.5 | 7.4 | 2.7 |
| Conversion[b] | — | 30.4 | 31.9 | 37.4 | 36.6 | 34.6 |
| Total Liquid Product Quality | | | | | | |
| N (total) | 1.79 | 1.73 | 1.59 | 1.86 | 2.12 | 2.20 |
| N (basic) | 1.30 | 1.22 | 1.60 | 1.50 | 1.35 | 1.47 |
| H/C (atomic) | 1.62 | 1.47 | 1.45 | 1.48 | 1.50 | 1.53 |
| CCR (wt. %) | 1.39 | 0.72 | 1.40 | 1.27 | 1.05 | 0.93 |
| Pour Point (°F.) | 79 | 17 | 23 | 9 | 13 | 18 |

[a]Weight of catalyst divided by weight of oil pumped prior to regeneration.
[b]Net 850° F.$^-$ conversion excluding coke.
[c]Continuous Run - no periodic regeneration.
[d]Presteamed NaZSM-5 extrudate was used in these runs.

What is claimed is:

1. A process for dewaxing a shale oil and converting the shale oil charge fraction to liquid products of lower boiling range which comprises contacting said charge fraction with a crystalline zeolite characterized by a silica/alumina ratio greater than 12, a constraint index between about 1 and about 12 and an acid activity measured by the alpha scale less than 10, said contacting being conducted at about 450° to about 540° C. and a pressure not greater than about 100 psig.

2. A process according to claim 1 wherein the ion exchange sites of said zeolite are essentially occupied by alkali metal cations.

3. A process according to claim 2 wherein said alkali metal is sodium.

4. A process according to claim 1 wherein said contacting is conducted in the absence of hydrogen.

5. A process according to claim 1 wherein said zeolite is zeolite ZSM-5.

6. A process according to claim 1 wherein said contacting is conducted at a pressure less than about 75 psig.

7. A process according to claim 6 wherein said contacting is conducted at atmospheric pressure.

8. A process according to claim 3 wherein said zeolite is zeolite ZSM-5.

9. A process according to claim 4 wherein the ionic exchange sites of zeolite are essentially occupied by alkali metal cations.

10. A process according to claim 9 wherein said alkali metal is sodium.

11. A process according to claim 10 wherein said zeolite is ZSM-5.

* * * * *